US007451581B2

(12) United States Patent
Kim

(10) Patent No.: US 7,451,581 B2
(45) Date of Patent: Nov. 18, 2008

(54) APPARATUS FOR SWINGING A LAST HOPPER OF AUTOMATIC TABLET DISPENSING AND PACKAGING SYSTEM

(75) Inventor: Jun Ho Kim, Taegu (KR)

(73) Assignee: JVM Co., Ltd., Taegu (KR)

( * ) Notice: Subject to any disclaimer, the term of this patent is extended or adjusted under 35 U.S.C. 154(b) by 0 days.

(21) Appl. No.: 11/506,329

(22) Filed: Aug. 18, 2006

(65) Prior Publication Data

US 2008/0072534 A1 Mar. 27, 2008

(51) Int. Cl.
*B65B 39/00* (2006.01)
*B65B 35/00* (2006.01)
*B65B 61/26* (2006.01)

(52) U.S. Cl. ..... 53/131.5; 53/553; 53/247; 221/204

(58) Field of Classification Search ..... 53/246–248, 53/255, 260, 525, 553, 562; 221/200, 204
See application file for complete search history.

(56) References Cited

U.S. PATENT DOCUMENTS 2,005,496 A * 6/1935 Donovan et al. ..... 221/151
2,710,712 A * 6/1955 Friedman ..... 53/167
2,712,883 A * 7/1955 Esposito et al. ..... 221/201
3,408,876 A * 11/1968 Andrews ..... 74/61
3,410,452 A * 11/1968 Igel et al. ..... 221/13
3,774,368 A * 11/1973 Paprzycki et al. ..... 53/167
3,842,569 A * 10/1974 McClelland et al. ..... 53/469
4,019,547 A * 4/1977 Ross ..... 141/11
4,519,179 A * 5/1985 Meier ..... 53/236
4,955,178 A * 9/1990 Shroyer ..... 53/148
5,459,983 A * 10/1995 Sadek et al. ..... 53/560
5,987,859 A * 11/1999 Dreger ..... 53/544
6,311,743 B1 * 11/2001 Baroncini ..... 141/234
6,647,702 B1 * 11/2003 Kim ..... 53/568
2004/0226855 A1 * 11/2004 Kim ..... 206/570
2006/0070352 A1 * 4/2006 Momich ..... 53/437
2006/0273106 A1 * 12/2006 Kim ..... 221/200

FOREIGN PATENT DOCUMENTS

JP 03043301 A * 2/1991

* cited by examiner

*Primary Examiner*—Stephen F Gerrity
(74) *Attorney, Agent, or Firm*—John K. Park; Park Law Firm

(57) ABSTRACT

An apparatus for swinging a last hopper of an automatic tablet dispensing and packaging system having a tablet cassette and a deck, includes a last hopper, a shutter controller, and a last hopper swinging device. The last hopper, for collecting one or more tablets falling from the tablet cassette, has a top opening, a bottom orifice, and a shutter provided at the bottom orifice. The shutter controller is provided for opening the shutter to release the tablets collected in the last hopper. The last hopper swinging device is provided for swinging the last hopper in order for the tablets in the last hopper to be aligned in a predetermined direction. The tablets aligned by the last hopper swinging device drop into a wrapping paper in the predetermined direction to be packaged.

10 Claims, 12 Drawing Sheets

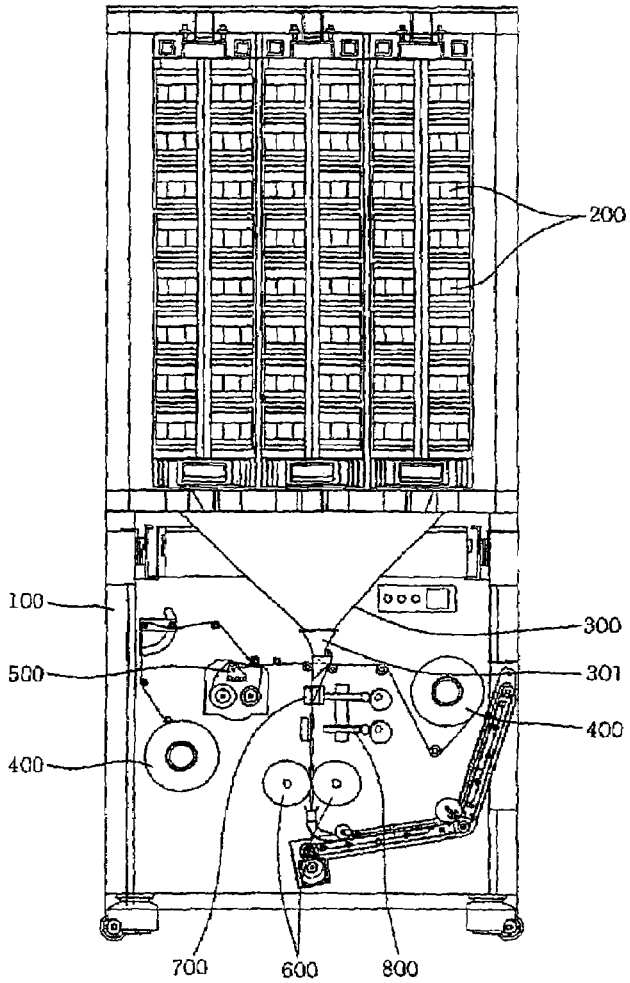
Fig. 10 [PRIOR ART]

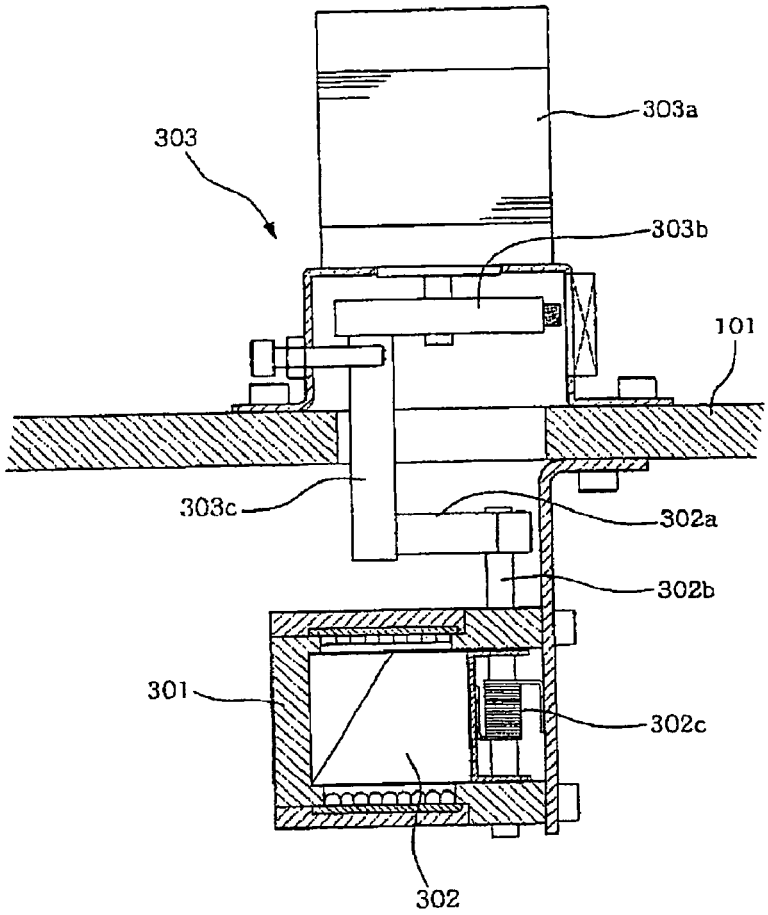
Fig. 11 [PRIOR ART]

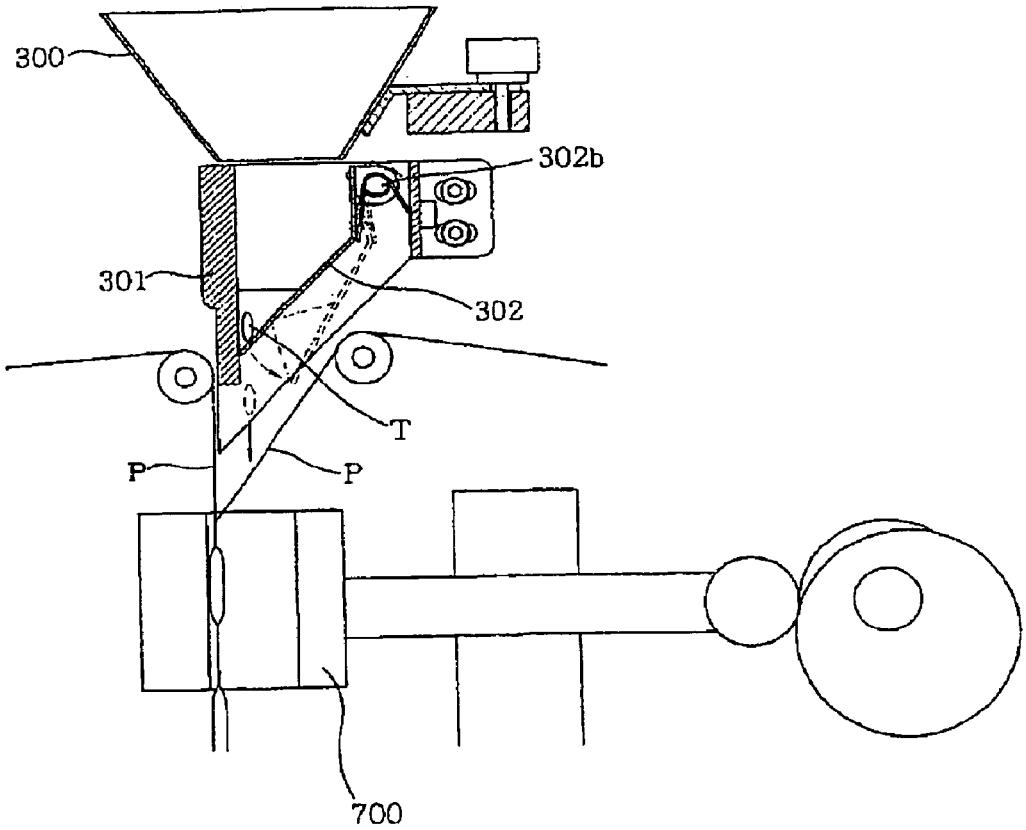
Fig. 12 [PRIOR ART]

APPARATUS FOR SWINGING A LAST HOPPER OF AUTOMATIC TABLET DISPENSING AND PACKAGING SYSTEM

BACKGROUND OF THE INVENTION

The present invention relates to an apparatus for swinging a last hopper of automatic tablet dispensing and packaging system.

More particularly, this invention relates to an apparatus that aligns the tablets for packaging to fit in the packing wrappers in order to prevent the wrappers from being ripped or distorted in the process of packaging.

A traditional automatic tablet packaging system is shown in FIG. 10. The traditional system has a plurality of tablet cassette (200) on the top of the body (100) and a hopper (300) with a last hopper (301). Also, the system includes a wrapper roll (400), a printing device (500), a driving roller (600), a sealing device (700), and a punching device (800).

As shown in FIG. 11 and FIG. 12, in the traditional automatic tablet packaging system, the last hopper (301) was installed at the deck (101) below the hopper (300) in the main frame (101) of the body (100). The shutter controller (303) controls the shutter (302) to open and shut the last hopper (301).

When the rotational member (303*b*) rotates by a given angle by the motor (303*a*), the angle shift pin (303*c*) moves to push the trigger (302*a*) by a given angle, which rotates the shutter (302) connected to the rotation pin (302*b*) and opens the bottom of the last hopper (301) in order for the tablet (T) to be released into the wrapper (P).

The tablet (T) is packaged in the wrapper (P) by heat-sealing by the sealing device (700).

After the release, the motor (303*a*) rotates in reverse direction to shift the angle shift pin (303*c*) reversely, which releases the push by the angle shift pin (303*c*) of the trigger (302*a*) and the elastic pressure on the rotation pin (302*b*) by the strain spring (302*c*) to recover the rotation pin (302*b*) resulting to close the bottom of the last hopper (301).

In the above-mentioned traditional automatic packaging system, however, there have been some problems.

A long tablet standing vertically in the last hopper may fall down into the wrapper keeping its direction. Then, a tip of the tablet could be placed right under the sealing line to be crushed or damaged. Sometimes, the packing wrapper was also damaged. The problem was more serious with a bigger tablet.

Accordingly, a need for an apparatus for swinging a last hopper of automatic tablet dispensing and packaging system has been present for a long time. This invention is directed to solve these problems and satisfy the long-felt need.

SUMMARY OF THE INVENTION

The present invention contrives to solve the disadvantages of the prior art.

An objective of the invention is to provide an apparatus for swinging a last hopper of automatic tablet dispensing and packaging system.

Another object of the invention is to provide an apparatus for swinging a last hopper of an automatic tablet dispensing and packaging system, which prevents tablets for packing from standing upright in the wrapper and from being damaged in the process of sealing of the wrapper.

Still another object of the invention is to provide an apparatus for swinging a last hopper of an automatic tablet dispensing and packaging system, which provides a last hopper swinging device with a simple and reliable structure.

For the above objects. an apparatus for swinging a last hopper of an automatic tablet dispensing and packaging system having a tablet cassette and a deck includes a last hopper, a shutter controller, and a last hopper swinging device.

The last hopper, for collecting one or more tablets falling from the tablet cassette, has a top opening, a bottom orifice, and a shutter provided at the bottom orifice.

The shutter controller is provided for opening the shutter to release the tablets collected in the last hopper.

The last hopper swinging device is provided for swinging the last hopper in order for the tablets in the last hopper to be aligned in a predetermined direction.

The last hopper swinging device includes a device for shaking, jolting, oscillating, vibrating, jerking, and tapping of the last hopper.

The tablets aligned by the last hopper swinging device drop into a wrapping paper in the predetermined direction to be packaged.

The deck defining a front side and a rear side is disposed vertically, and the last hopper is provided at the front side of the deck. The shutter controller is provided at the rear side of the deck, and the last hopper swinging device is provided on the deck.

The last hopper swinging device includes a sliding member, a support-recovering member, and a cam controller.

The sliding member has a first end provided at the rear side of the deck and a second end that penetrates through the deck and is horizontally slidable.

The support-recovering member, provided at the rear side of the deck, is for supporting and recovering the sliding member to an original position.

The cam controller, provided at the rear side of the deck, has a cam contacting the second end of the sliding member and oscillating the sliding member horizontally by an eccentric rotation caused by a motor.

The support-recovering member includes a pair of support rollers, a slant guide plate, and a fixing bracket.

The pair of support rollers are distantly disposed on a side of the sliding member.

The slant guide plate, inserted between the support rollers, has a recovering slant on a top side for recovering the sliding member downward to the original position.

The fixing bracket, for fixing the slant guide plate, is fixed to the rear side of the deck.

The support-recovering member further includes a pair of contact rollers and a roller bracket. The pair of contact rollers are provided on both sides of the sliding member. The roller bracket, provided at the rear side of the deck, is for rotatably holding the contact rollers in place.

The sliding member further includes a stopping bump provided at a top edge of the sliding member for limiting a horizontal motion of the sliding member.

The last hopper swinging device includes a horizontal shift member, an elastic recovering member, and a rotational driving member.

The horizontal shift member includes a first end installed at the rear side of the deck, a second end provided to penetrate the deck horizontally slidably, and a rotational roller provided at the second end rotatably.

The elastic recovering member, provided at the rear side of the deck, is for supporting and recovering the horizontal shift member to an original position.

The rotational driving member provided at the rear side of the deck includes a disc with a plurality of round grooves around the circumference of the disc, for driving the horizontal shift member, engaged with the rotational roller, in a reciprocating motion horizontally with a driving motor.

The elastic recovering member includes a pair of guide rollers, a horizontal guide plate, and an elastic recovering spring.

The pair of guide rollers are distantly disposed on a side of the horizontal shift member.

The horizontal guide plate is inserted between the guide rollers and provided at the rear side of the deck.

The elastic recovering spring has a first end fixed to the horizontal guide plate and a second end fixed to a side surface of the horizontal shift member.

The last hopper swinging device includes a flat plate member, a plate support, and a link driving device.

The flat plate member has a first end provided at the rear side of the deck and a second end that penetrates through the deck and is horizontally slidable.

The plate support, provided at the rear side of the deck, is for supporting a horizontal motion of the flat plate member.

The link driving device has a driving link with a first end connected to the second end of the flat plate by hinge, a connecting member with a first end connected to a second end of the driving link, and a driving motor connected to a second end of the connecting member for rotating the connecting member.

The plate support includes a guide block provided on a bottom side of the flat plate member, a guide rail inserted to the guide block slidably, and an installing member provided on a top surface of the guide rail and at the rear side of the deck.

The last hopper swinging device further includes a position detector for detecting a position of the flat plate member in order to recover the flat plate member to an original position after a horizontal movement of the flat plate member by the link driving device.

The position detector includes a detecting bar installed on the flat plate member an a detecting sensor for sensing the position of the flat plate member according to the presence of the detecting bar and for outputting information on the position to the driving motor.

The advantages of the present invention are: (1) the apparatus for swinging a last hopper of automatic tablet dispensing and packaging system is to prevent tablets from standing upright in the packaging wrapper; and (2) the apparatus prevents tablets from being damaged in the process of packaging.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 10 is a schematic front view of an automatic tablet packaging system of a prior art;

FIG. 11 is a top plan view of a last hopper according to a prior art; and

FIG. 12 is a front plan view of a last hopper according to a prior art.

DETAILED DESCRIPTION OF THE INVENTION

Figure 1:
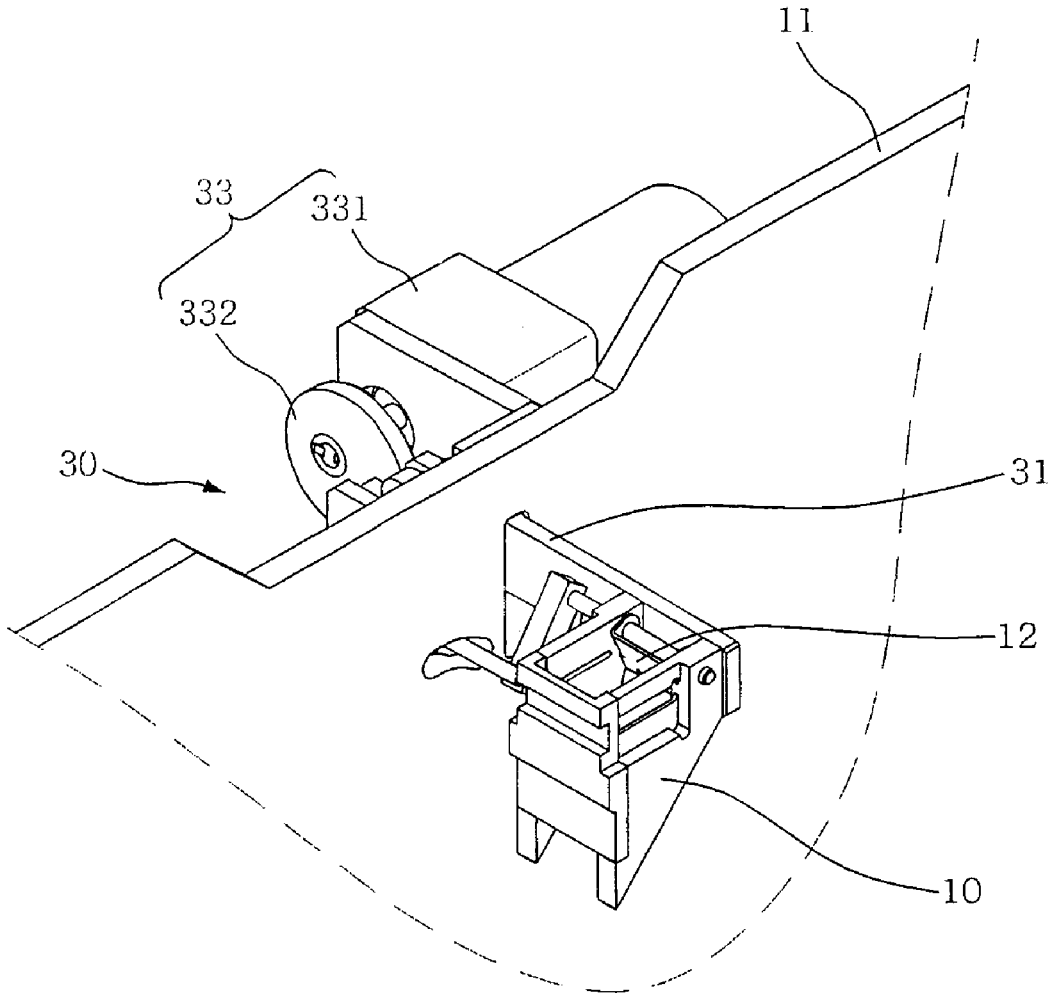
FIG. 1 is a perspective view showing a last hopper swinging device assembled according to the present invention.
Figure 2:
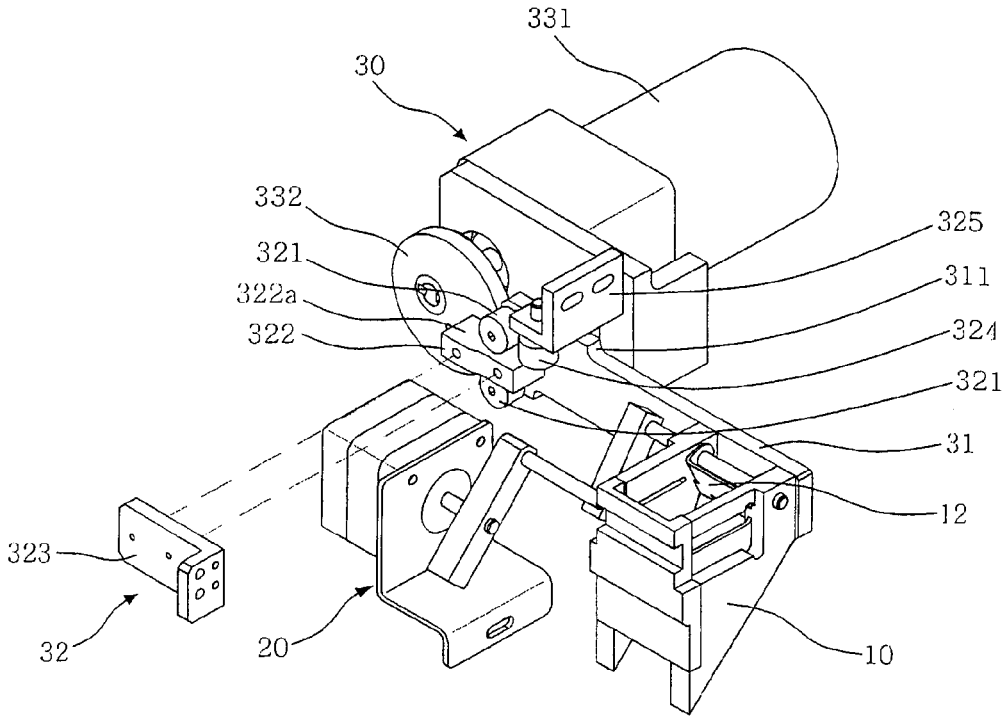
FIG. 2 is a partial blow-up view of the invention.
Figure 3:
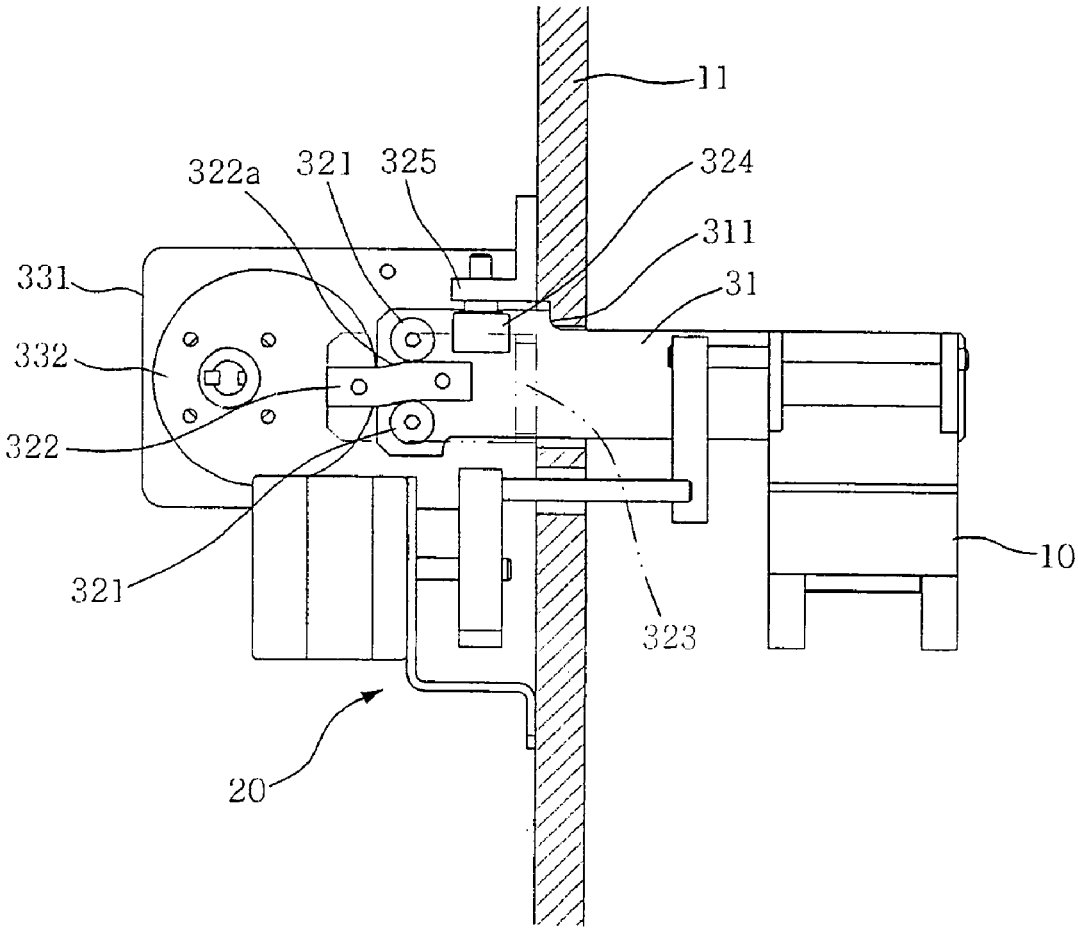
FIG. 3 is a front cross-sectional view of the invention.

FIG. 1 is a perspective view showing a last hopper swinging device assembled according to the present invention. FIG. 2 is a partial blow-up view of the invention. FIG. 3 is a front cross-sectional view of the invention.

The apparatus for swinging a last hopper of an automatic tablet dispensing and packaging system having a tablet cassette and a deck (11) includes a last hopper (10), a shutter controller (20), and a last hopper swinging device (30).

The last hopper (10), for collecting one or more tablets falling from the tablet cassette (not shown), has shutter (12) provided at a bottom of the last hopper (10).

The shutter controller (20) is provided for opening the shutter (12) to release the tablets collected in the last hopper (10) into a wrapper (not shown).

Figure 4:
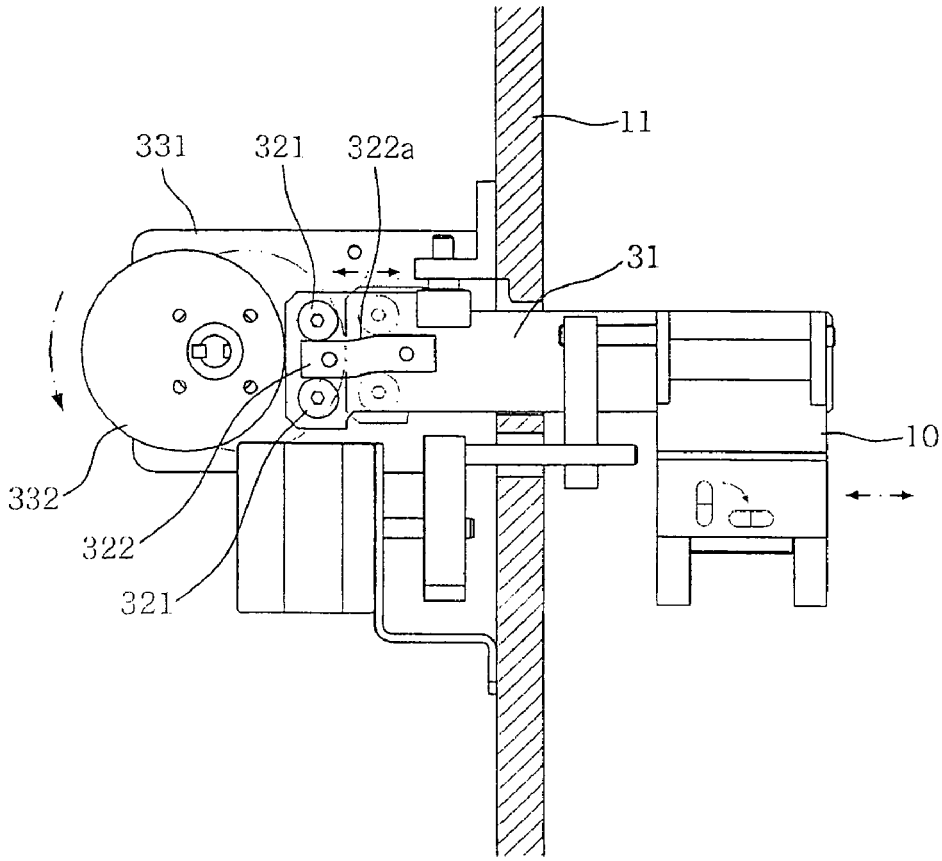
FIG. 4 is a front cross-sectional view showing an operation of the apparatus according to the invention.

The last hopper swinging device (30) is provided for swinging the last hopper (10) in order for the tablets in the last hopper (10) to be aligned in a predetermined direction. This swinging motion makes the tablets with an upright position in the last hopper (10) toppled in a given direction as shown in FIG. 4. The swinging motion includes shaking, jolting, oscillating, vibrating, jerking, and tapping of the last hopper (10).

The tablets aligned by the last hopper swinging device (30) drop into the wrapping paper in the predetermined direction to be packaged.

The deck (11) defining a front side and a rear side is disposed vertically, and the last hopper (10) is provided at the front side of the deck (11). The shutter controller (20) is provided at the rear side of the deck (11), and the last hopper swinging device (30) is provided on the deck (11).

The last hopper swinging device (30) includes a sliding member (31), a support-recovering member (32), and a cam controller (33).

The sliding member (31) has a first end provided at the rear side of the deck (11) and a second end that penetrates through the deck (11) and is provided horizontally slidable.

The support-recovering member (32), provided at the rear side of the deck (11), is for supporting and recovering the sliding member (31) to an original position.

The cam controller (33), provided at the rear side of the deck (11), has a cam (332) contacting the second end of the sliding member (31) and oscillating the sliding member (31) back and forth horizontally by an eccentric rotation caused by a motor .

The support-recovering member (32) includes a pair of support rollers (321), a slant guide plate (322), and a fixing bracket (323).

The pair of support rollers (321) are distantly disposed on a side of the sliding member (31) and support the sliding member (31) to stabilize the horizontal motion.

The slant guide plate (322), inserted between the support rollers (321), has a recovering slant (322*a*) on a top side for recovering the sliding member (31) downward to the original position, and guides the movement of the support rollers (321) and the horizontal movement of the sliding member (31).

The recovering slant (322*a*) makes the support roller (321) at the top slide down by the weight of the sliding member (31) and recover the sliding member (31) to an original position.

The fixing bracket (323), for fixing the slant guide plate, is fixed to the rear side of the deck (11).

The support-recovering member (32) further includes a pair of contact rollers (324) and a roller bracket (325). The pair of contact rollers (324) are provided on both sides of the sliding member (31). The roller bracket, provided at the rear side of the deck (11), is for rotatably holding the contact rollers in place.

The cam controller (33) moves the sliding member (31) horizontally by rotating the cam (332) engaging the motor (331) eccentrically.

The sliding member (31) further includes a stopping bump (311) provided at a top edge of the sliding member (31) for limiting a horizontal motion of the sliding member (31).

FIG. 4 is a front cross-sectional view showing an operation of the apparatus according to the invention When the tablets are collected in the last hopper (10), the motor (331) rotates the cam (332), by which the sliding member (31) engaging the cam (332) is pushed away from the center of rotation.

Then, the support rollers (321) installed on the sliding member (31) rise along the recovering slant (322*a*), and the last hopper (10) moves horizontally away from the deck (11).

If the cam (332) keeps rotating and the cam (332) engages the sliding member (31) toward the center of rotation of the cam (332), the support rollers (321) move down along the recovering slant (322*a*) by the weight of the sliding member (31) recovering the sliding member (31) to the original position, by which the last hopper (10) installed on the sliding member (31) moves horizontally toward the deck (11).

The last hopper (10) repeats the movement toward and away from the deck (11) by the horizontal reciprocating movement of the cam (332) and the sliding member (31). The horizontal oscillation of the last hopper (10) topples the tablets standing upright in the last hopper (10).

Figure 5:
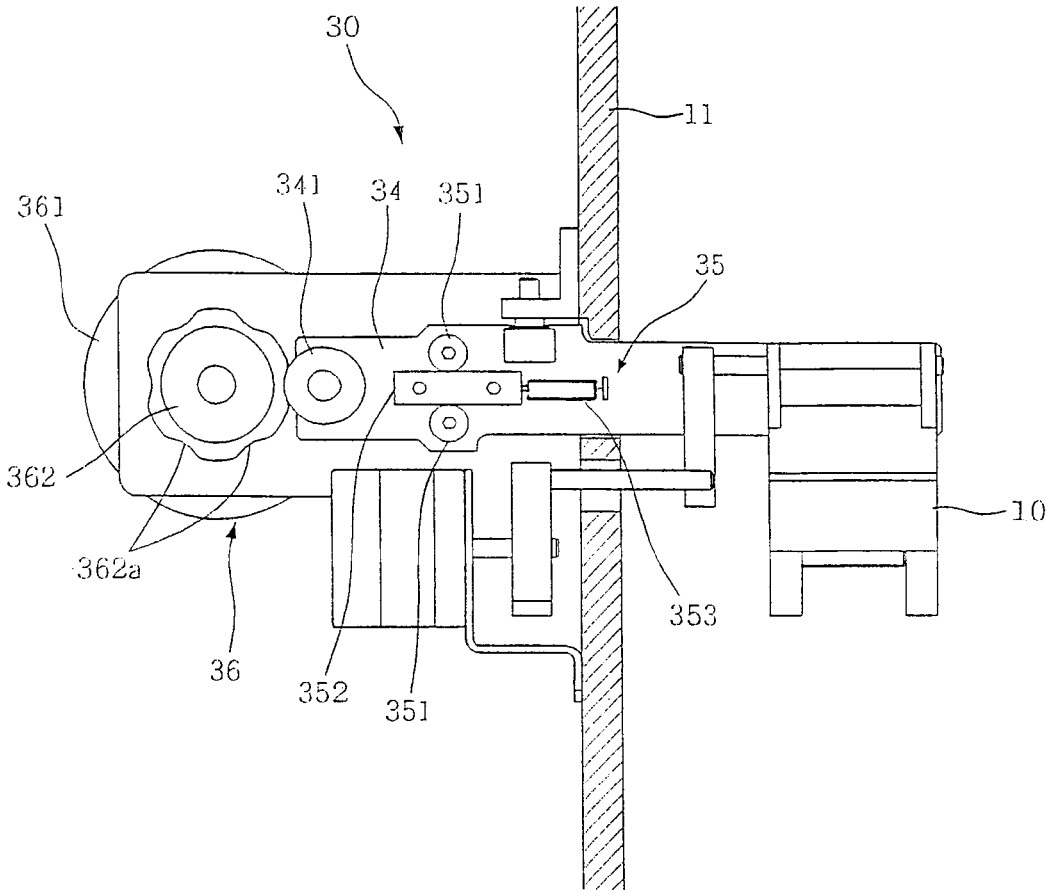
FIG. 5 is a front cross-sectional view showing another embodiment of the invention.

FIG. 5 is a front cross-sectional view showing another embodiment of the invention.

The last hopper swinging device (30) includes a horizontal shift member (34), an elastic recovering member (35), and a rotational driving member (36).

The horizontal shift member (34) includes a first end installed at the rear side of the deck (11), a second end provided to penetrate the deck (11) horizontally slidably, and a rotational roller (341) provided at the second end rotatably. The horizontal shift member (34) fixes the last hopper (10) rotatably and supports the rotational roller (341) rotatably.

The elastic recovering member (35), provided at the rear side of the deck (11), is for supporting and recovering the horizontal shift member (34) to an original position.

The elastic recovering member (35) includes a pair of guide rollers (351), a horizontal guide plate (352), and an elastic recovering spring (353).

The pair of guide rollers (351) are distantly disposed on a side of the horizontal shift member (34).

The horizontal guide plate (352) is inserted between the guide rollers (351) and provided at the rear side of the deck (11).

The elastic recovering spring (35) has a first end fixed to the horizontal guide plate (352) and a second end fixed to a side surface of the horizontal shift member (34).

The guide rollers (351) and the horizontal guide plate (352) support and guide the horizontal reciprocating movement of the horizontal shift member (34). The elastic recovering spring (35) recovers the horizontal shift member (34) to the original position.

The rotational driving member (36) provided at the rear side of the deck (11) includes a disc (362) with a plurality of round grooves (362*a*) around the circumference of the disc (362), for driving the horizontal shift member (34), engaged with the rotational roller (341), in a reciprocating motion horizontally with a driving motor (361).

Figure 6:
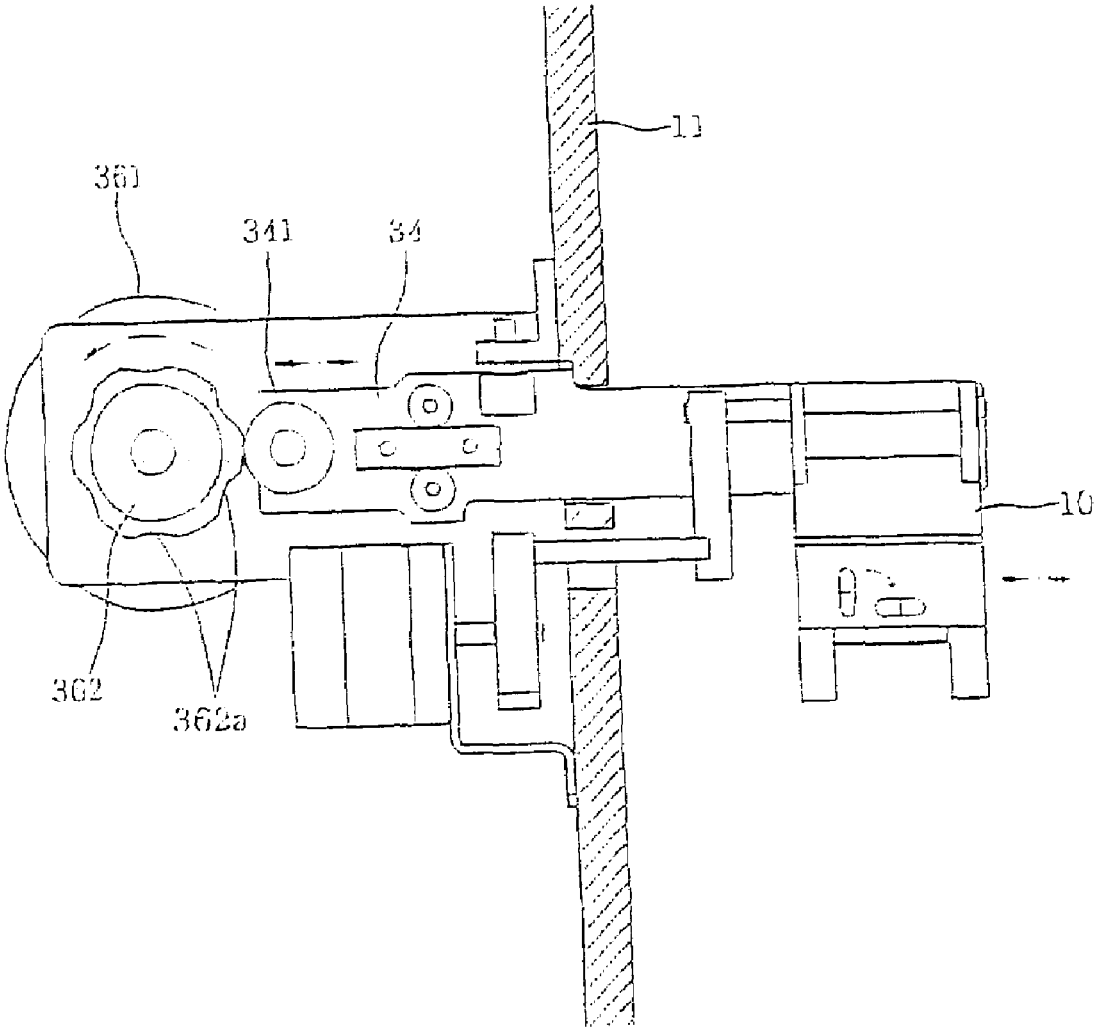
FIG. 6 is a front cross-sectional view showing an operation of the apparatus according to the embodiment of FIG. 5.

FIG. 6 is a front cross-sectional view showing an operation of the apparatus according to the embodiment of FIG. 5.

When the tablets are collected in the last hopper (10), the driving motor (361) rotates the disc (362), by which the rotational roller (341) engaging the round grooves (362*a*) of the disc (362) is rotated.

Then, the rotational rollers (341) moves horizontally back and forth according to the round grooves (362*a*), by which the horizontal shift member (34), installed on the rotational rollers (341) and supported by the elastic recovering spring (353), moves horizontally back and forth through the deck (11).

By this horizontal reciprocating motion, the last hopper (10) repeats the movement toward and away from the deck (11). The horizontal oscillation of the last hopper (10) topples the tablets standing upright in the last hopper (10).

Figure 7:
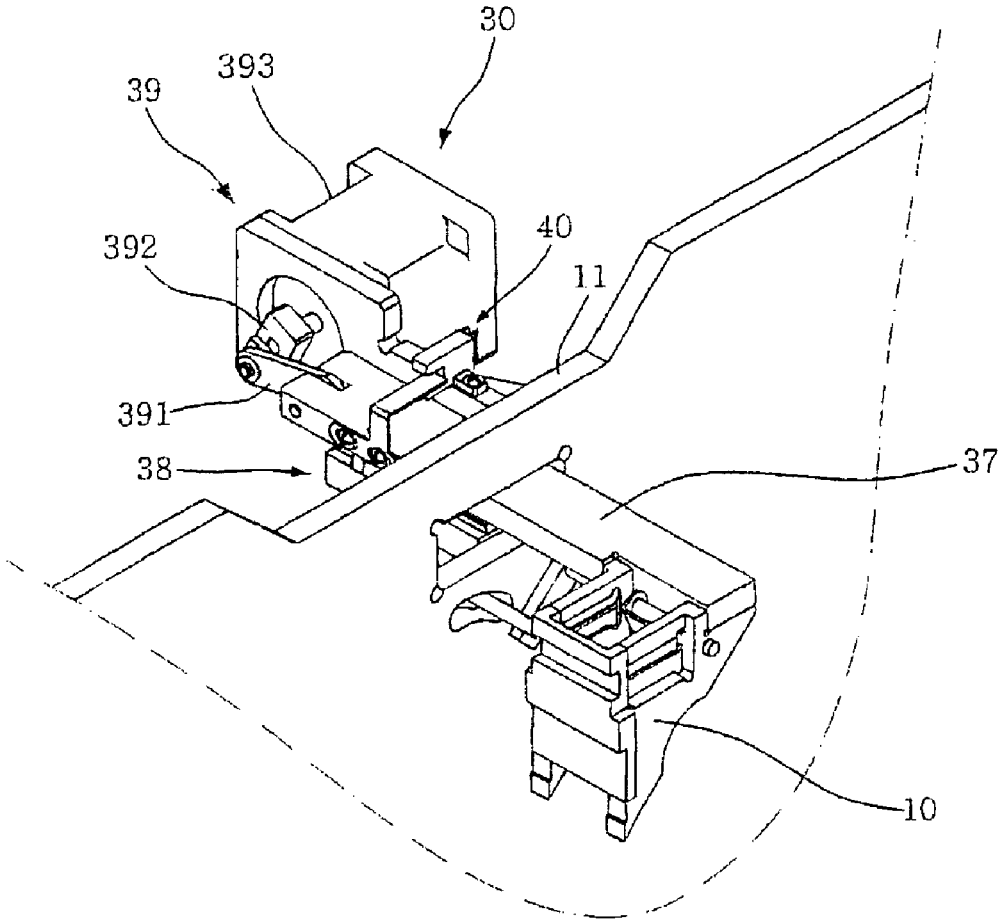
FIG. 7 is a perspective view showing a last hopper swinging device assembled according to still another embodiment of the present invention.
Figure 8:
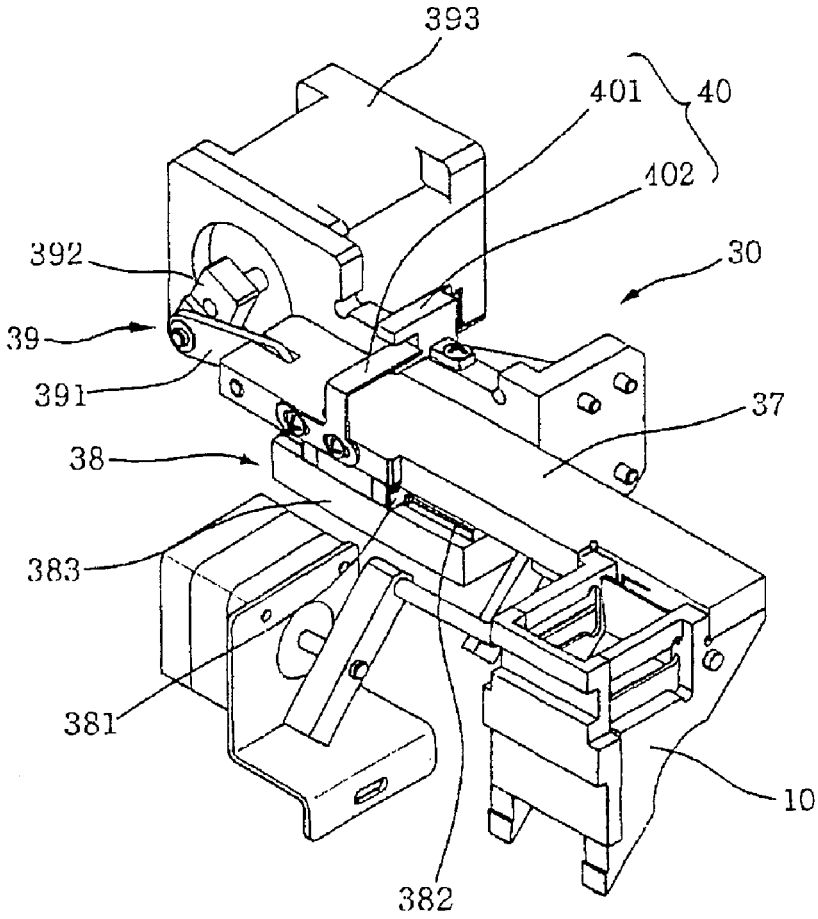
FIG. 8 is a detailed perspective view of the embodiment of FIG. 7.

FIG. 7 is a perspective view showing a last hopper swinging device assembled according to still another embodiment of the present invention.

The last hopper swinging device (30) includes a flat plate member (37), a plate support (38), and a link driving device (39).

The flat plate member (37) has a first end provided at the rear side of the deck (11) and a second end that penetrates through the deck (11) and is horizontally slidable. The flat plate member (37) fixes the last hopper (10) slidably.

The plate support (38), provided at the rear side of the deck (11), is for supporting a horizontal motion of the flat plate member (37).

The plate support (38) includes a guide block (381) provided on a bottom side of the flat plate member (37), a guide rail (382) inserted to the guide block (381) slidably, and a installing member (383) provided on a top surface of the guide rail (382) and at the rear side of the deck (11).

The guide block (381) and the guide rail (382) are for guiding the horizontal movement of the flat plate member (37). The installing member (383) installed on the deck (11) is for supporting the guide rail (382).

The link driving device (39) has a driving link (391) with a first end connected to the second end of the flat plate member (37) by a hinge, a connecting member (392) with a first end connected to a second end of the driving link (391), and a driving motor (393) connected to a second end of the connecting member (392) for rotating the connecting member (392). The link driving device (39) moves the flat plate member (37) back and forth by the rotation of the connecting member (392) by the driving motor (393).

The last hopper swinging device (30) further includes a position detector (40) for detecting a position of the flat plate member (37) in order to recover the flat plate member (37) to an original position after a horizontal movement of the flat plate member (37) by the link driving device (39).

The position detector (40) includes a detecting bar (401) installed on the flat plate member (37) and a detecting sensor (402) for sensing the position of the flat plate member (37)

according to the presence of the detecting bar (401) and for outputting information on the position to the driving motor (393).

The position detector (40) detects the position of the flat plate member (37) by detecting the position of the detecting bar (401) with the detecting sensor (402), and outputs information on position, by which the driving motor (393) moves the flat plate member (37) with a motor controller of prior art to recover the flat plate member (37) to the original position.

By recovering the flat plate member (37) to the original position, the last hopper (10) installed on the flat plate member (37) returns to the original position, which makes collecting of tablets by the last hopper (10) stable even after the completion of the oscillation.

Figure 9:
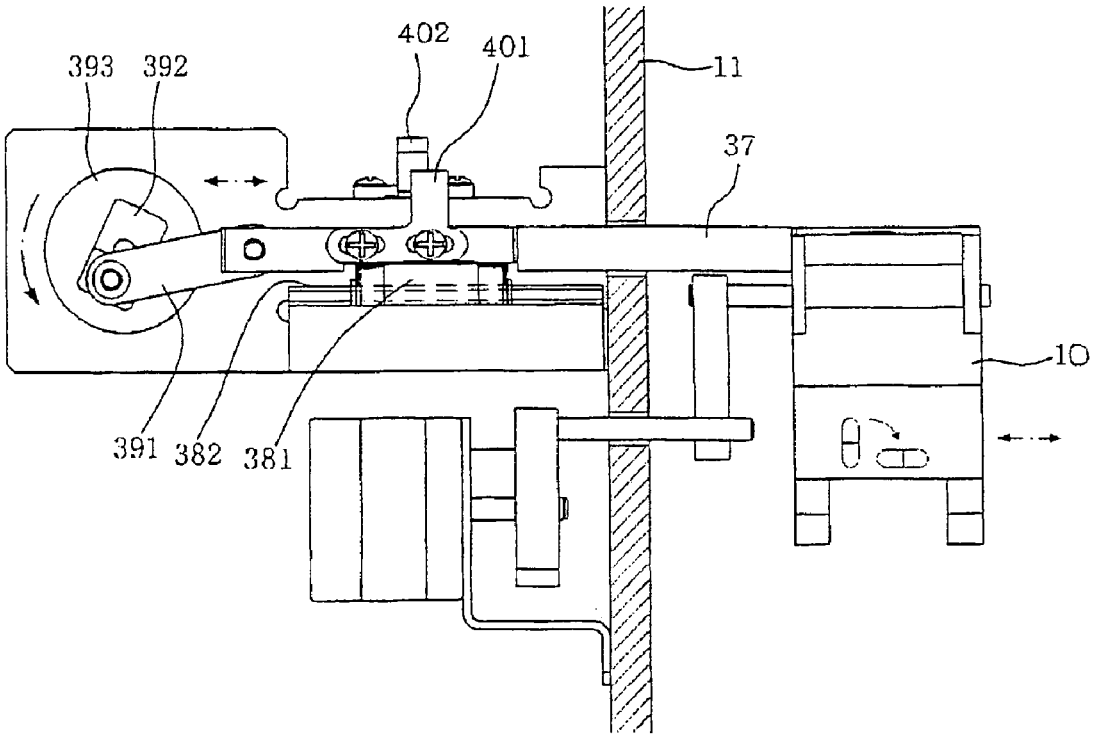
FIG. 9 is a front plan view of an operation of the embodiment of FIG. 7.

FIG. 9 is a front plan view of an operation of the embodiment of FIG. 7.

When the tablets are collected in the last hopper (10), the driving motor (393) rotates the connecting member (392), by which the driving link (391) is rotated, by which the flat plate member (37) connected to the driving link (391) moves back and forth horizontally while supported by the guide block (381) and the guide rail (382).

By this horizontal reciprocating motion, the last hopper (10) installed on the flat plate member (37) repeats the movement toward and away from the deck (11). The horizontal oscillation of the last hopper (10) topples the tablets standing upright in the last hopper (10).

After the completion of the oscillation of the last hopper (10), the position of the flat plate member (37) is detected with the detecting bar (401) and the detecting sensor (402), which controls the driving motor (393) to return the flat plate member (37) to the original position in order to recover the last hopper (10) to the original position.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. An automatic tablet dispensing and packaging system comprising:

a) a plurality of tablet cassettes;

b) a printing device;

c) a sealing device;

d) a deck;

e) a last hopper, for collecting one or more tablets falling from the tablet cassette, having a shutter provided at a bottom of the last hopper;

f) a shutter controller for opening the shutter to release the tablets collected in the last hopper; and g) a last hopper swinging device for swinging the last hopper in order for the tablets in the last hopper to be aligned in a predetermined direction, wherein the tablets aligned by the last hopper swinging device drop into a wrapping paper in the predetermined direction to be packaged, wherein the deck comprises a front side and a rear side, and is disposed vertically, wherein the last hopper is provided at the front side of the deck, wherein the shutter controller is provided at the rear side of the deck, wherein the last hopper swinging device is provided on the deck, wherein the last hopper swinging device comprises:

(i) a sliding member having a first end provided at the rear side of the deck and a second end that penetrates through the deck and is horizontally slidable;

(ii) a support-recovering member, provided at the rear side of the deck, for supporting and recovering the sliding member to an original position; and (iii) a cam controller, provided at the rear side of the deck, with a cam contacting the second end of the sliding member and oscillating the sliding member horizontally by an eccentric rotation caused by a motor.

2. The system of claim 1, wherein the support-recovering member comprises:

a) a pair of support rollers distantly disposed on a side of the sliding member;

b) a slant guide plate, inserted between the support rollers, with a recovering slant on a top side for recovering the sliding member downward to the original position; and c) a fixing bracket, for fixing the slant guide plate, fixed to the rear side of the deck.

3. The system of claim 2, wherein the support-recovering member further comprises:

a) a pair of contact rollers provided on both sides of the sliding member; and b) a roller bracket, provided at the rear side of the deck, for rotatably holding the contact rollers in place.

4. The system of claim 1, wherein the sliding member further comprises a stopping bump provided at a top edge of the sliding member for limiting a horizontal motion of the sliding member.

5. An automatic tablet dispensing and packaging system comprising:

a) a plurality of tablet cassettes;

b) a printing device;

c) a sealing device;

d) a deck;

e) a last hopper, for collecting one or more tablets falling from the tablet cassette, having a shutter provided at a bottom of the last hopper;

f) a shutter controller for opening the shutter to release the tablets collected in the last hopper; and g) a last hopper swinging device for swinging the last hopper in order for the tablets in the last hopper to be aligned in a predetermined direction, wherein the tablets aligned by the last hopper swinging device drop into a wrapping paper in the predetermined direction to be packaged, wherein the deck comprises a front side and a rear side, and is disposed vertically, wherein the last hopper is provided at the front side of the deck, wherein the shutter controller is provided at the rear side of the deck, wherein the last hopper swinging device is provided on the deck, wherein the last hopper swinging device comprises:

(i) a horizontal shift member comprising a first end installed at the rear side of the deck, a second end provided to penetrate the deck horizontally slidably, and a rotational roller provided at the second end rotatably;

(ii) an elastic recovering member, provided at the rear side of the deck, for supporting and recovering the horizontal shift member to an original position; and (iii) a rotational driving member provided at the rear side of the deck, comprising a disc with a plurality of round grooves around the circumference of the disc, for driving the horizontal shift member, engaged with the rotational roller, in a reciprocating motion horizontally with a driving motor.

6. The system of claim 5, wherein the elastic recovering member comprises:

a) a pair of guide rollers distantly disposed on a side of the horizontal shift member;

b) a horizontal guide plate, inserted between the guide rollers and provided at the rear side of the deck; and c) an elastic recovering spring with a first end fixed to the horizontal guide plate and a second end fixed to a side surface of the horizontal shift member.

7. An automatic tablet dispensing and packaging system comprising:

a) a plurality of tablet cassettes;

b) a printing device;

c) a sealing device;

d) a deck;

e) a last hopper, for collecting one or more tablets falling from the tablet cassette, having a shutter provided at a bottom of the last hopper;

f) a shutter controller for opening the shutter to release the tablets collected in the last hopper; and g) a last hopper swinging device for swinging the last hopper in order for the tablets in the last hopper to be aligned in a predetermined direction, wherein the tablets aligned by the last hopper swinging device drop into a wrapping paper in the predetermined direction to be packaged, wherein the deck comprises a front side and a rear side, and is disposed vertically, wherein the last hopper is provided at the front side of the deck, wherein the shutter controller is provided at the rear side of the deck, wherein the last hopper swinging device is provided on the deck, wherein the last hopper swinging device comprises:

(i) a flat plate member having a first end provided at the rear side of the deck and a second end that penetrates through the deck and is horizontally slidable;

(ii) a plate support, provided at the rear side of the deck, for supporting a horizontal motion of the flat plate member; and (iii) a link driving device having a driving link with a first end connected to the second end of the flat plate by a hinge, a connecting member with a first end connected to a second end of the driving link, and a driving motor connected to a second end of the connecting member for rotating the connecting member.

8. The system of claim 7, wherein the plate support comprises:

a) a guide block provided on a bottom side of the flat plate member;

b) a guide rail inserted to the guide block slidably; and c) an installing member provided on a top surface of the guide rail and at the rear side of the deck.

9. The system of claim 7, wherein the last hopper swinging device further comprises a position detector for detecting a position of the flat plate member in order to recover the flat plate member to an original position after a horizontal movement of the flat plate member by the link driving device.

10. The system of claim 9, wherein the position detector comprises:

a) a detecting bar installed on the flat plate member; and b) a detecting sensor for sensing the position of the flat plate member according to the presence of the detecting bar and for outputting information on the position to the driving motor.

* * * * *